United States Patent [19]

Gringer

[11] Patent Number: 4,724,572

[45] Date of Patent: Feb. 16, 1988

[54] MODULAR TROWEL

[75] Inventor: Donald Gringer, Bedford, N.Y.

[73] Assignee: Allway Tools, Inc., Bronx, N.Y.

[21] Appl. No.: 733,759

[22] Filed: May 14, 1985

[51] Int. Cl.[4] ..... B05C 17/10

[52] U.S. Cl. ..... 15/235.4; 16/110 R

[58] Field of Search ..... 15/235.4, 235.5, 235.6, 15/235.7, 235.8, 143 R, 145; 425/458; 16/110 R, 114 R; 51/392, 393; 81/489; 7/167; 30/85, 342

[56] References Cited

U.S. PATENT DOCUMENTS

| | | | |
|---|---|---|---|
| 92,506 | 7/1869 | Ault | 15/235.4 |
| 511,769 | 1/1894 | Gladding | 15/145 |
| 737,831 | 9/1903 | Feraud | 15/235.4 |
| 1,726,119 | 8/1929 | Paquette | 15/235.8 |
| 2,217,369 | 10/1940 | Jacobsen et al. | 15/235.4 |
| 2,800,013 | 7/1957 | Cesar | 15/235.4 |
| 3,178,748 | 4/1965 | Heepe | 15/145 X |
| 3,346,905 | 10/1967 | Scarpelli | 15/235.6 |
| 3,916,472 | 11/1975 | Carder | 15/235.6 |
| 4,316,302 | 2/1982 | Clark | 15/235.4 |
| 4,467,492 | 8/1984 | Harrington | 15/235.4 |

*Primary Examiner*—Harvey C. Hornsby
*Assistant Examiner*—Scott J. Haugland
*Attorney, Agent, or Firm*—Stiefel, Gross, Kurland & Pavane

[57] ABSTRACT

A modular trowel assembly (10) comprises a resilient substantially planar blade member (12) and a handle member (14) slidably mountable thereon. The blade member (12) contains an aperture (16) defined by a pair of spaced apart longitudinally extending integral resilient tangs (20, 22). The handle member (14) slidably receives the tangs (20, 22) therein in slots which serve to resiliently bias the tang (20, 22) when it is inserted for rigidly securing the mounted handle (14) to the blade (12) in the complete assembly (10). The blade member aperature (16) further comprises an integral resilient locking tab (30) disposed at each end for cooperating in permanently securing the mounted handle (14) to the blade 12, with the mounted handle (14) in cooperation with the resilient tangs (20, 22) reinforcing the rigidity of the blade (12) in the assembly (10).

10 Claims, 7 Drawing Figures

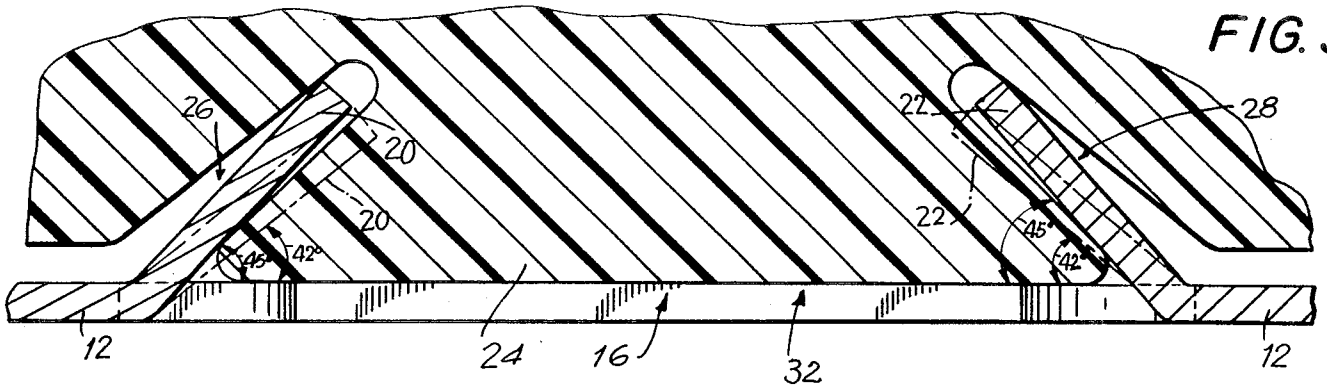
FIG. 3
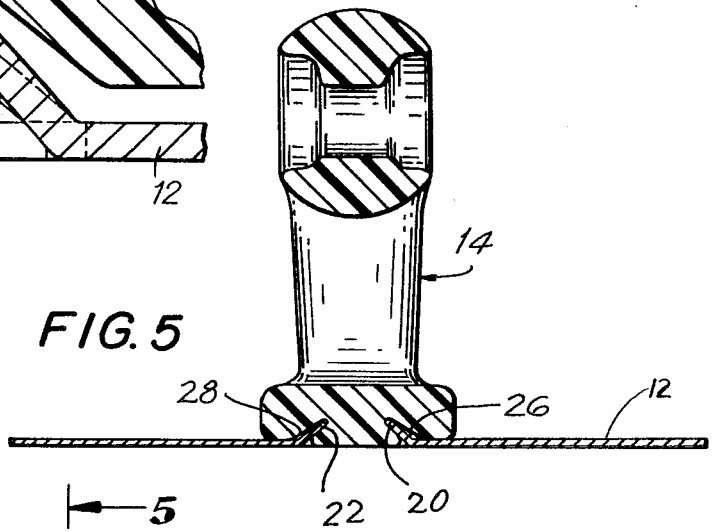
FIG. 5
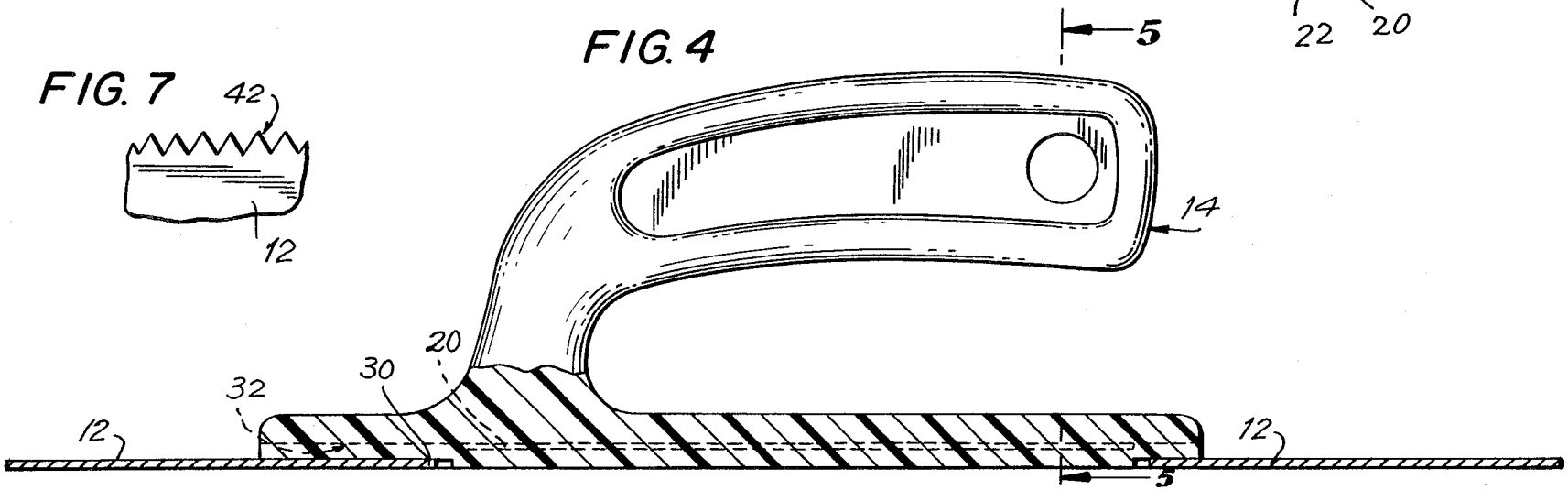
FIG. 4
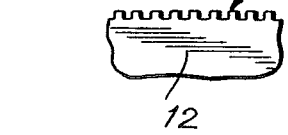
FIG. 6
FIG. 7

MODULAR TROWEL

TECHNICAL FIELD

The present invention relates to trowels and particularly to modular trowels that may be shipped knocked down for easy assembly by the user into a rigid trowel assembly.

BACKGROUND ART

Trowels are well known in the art and have existed for many, many years for various purposes such as spreading adhesive or cement, by way of example. With respect to the spreading of adhesive, generally the trowel blade is serrated or notched on one longitudinal edge. Generally, such prior art trowels consist of a substantially planar trowel blade and a handle assembly which is welded to the blade to provide a three piece structure. Although such an arrangement is suitable as a trowel in the final assembly, it is costly to manufacture as well as to ship, taking up, for example, as much as 80% more packing space than if the trowel could be shippped in a disassembled state. The difficulty with shipping prior art trowels in a disassembled state is that normally the end user does not have welding facilities to complete the assembly of the trowel nor is it efficient to maintain such welding facilities for the limited purpose of assembling a relatively small quantity of trowels. Moreover, applicant is not aware of any prior art trowels which can be shipped in pieces and easily assembled into a rigid structure. In addition, certain prior art notched trowels for speading adhesive have the notched blade on only one side and are specific for right hand or left hand work requiring an inventory of both types of trowels as opposed to providing a universal type of trowel in which the handle may be assembled in one of two ways depending on whether the assembled trowel is to be used for right hand work or left hand work. These disadvantages of the prior art are overcome by the present invention.

DISCLOSURE OF THE INVENTION

A modular trowel assembly is provided which comprises a resilient substantially planar blade member, such as one comprised of spring steel, and a handle member mountable thereon, such as one comprised of a moldable plastic such as polypropylene foam. The blade member has an aperture therein substantially disposed along the longitudinal axis of the blade member with the aperture being defined by a pair of spaced-apart longitudally extending resilient tangs which are upwardly disposed in opposition to each other at an acute angle to the plane of the blade member, such as an angle of substantially 42°, to define a slot therebetween. The handle member has a base portion comprising a pair of longitudinally spaced apart slots therein which are capable of slidably receiving the resilient tangs therein, with the handle member slots being in opposition to each other and disposed at an acute angle substantially complementary to a respective one of the tang acute angles but differing therefrom by an amount sufficient to resiliently bias the respective tang in the handle member slot when the tang is inserted therein for rigidly securing the mounted handle member to the blade member in the completed modular trowel assembly, such as an angle of 45° for a tang acute angle of 42°.

BRIEF DISCRIPTION OF DRAWINGS

FIG. 3 is an enlarged fragmentary sectional view taken along line 3—3 of FIG. 1 of the modular trowel assembly of FIG. 1;

FIG. 4 is a sectional view similar to FIG. 2 illustrating the modular trowel assembly of FIG. 1 in the fully assembled position;

FIG. 5 is a sectional view taken along line 5—5 of FIG. 4 of the modular trowel assembly of FIG. 1;

FIG. 6 is an enlarged fragmentary plan view of a typical notched trowel blade usable with the modular trowel assembly of FIG. and FIG. 7 is an enlarged fragmentary plan view similar to FIG. 6 of a different embodiment of another notched trowel blade usable with the modular trowel assembly of FIG. 1.

BEST MODE FOR CARRYING OUT THE INVENTION

Figure 1:
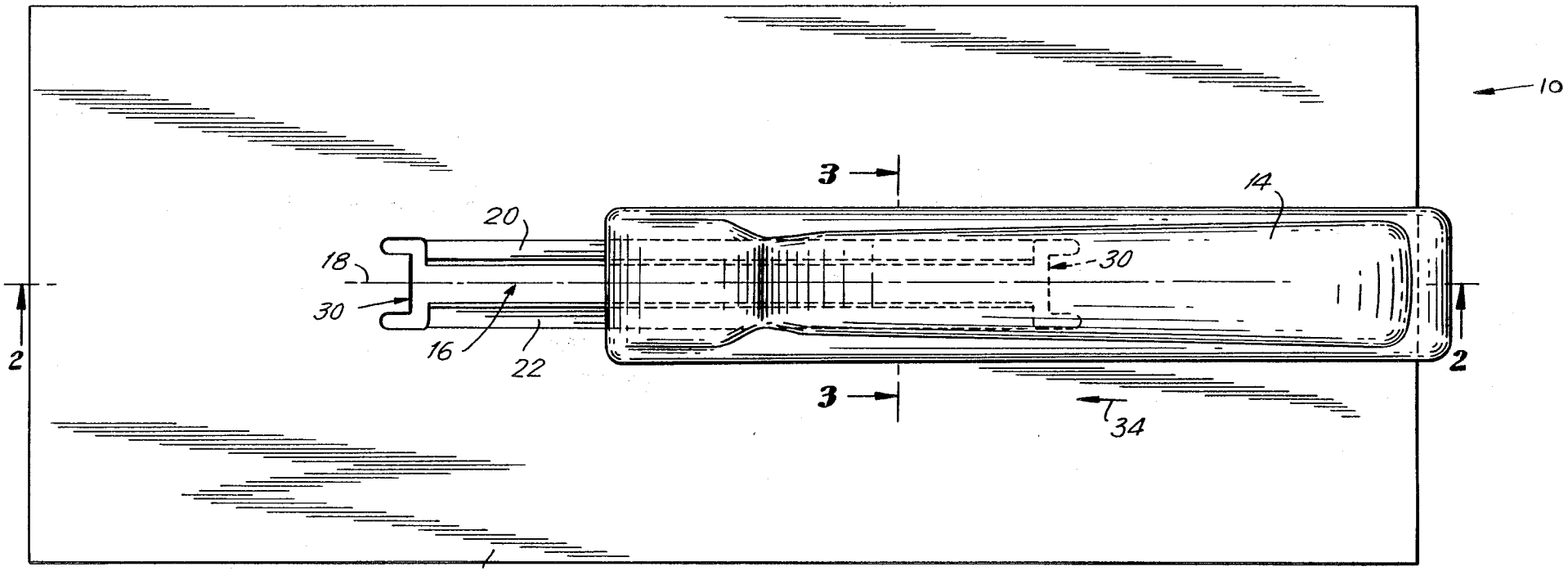
FIG. 1 is an enlarged plan view of the modular trowel assembly of the present invention in the partially assembled position.
Figure 2:
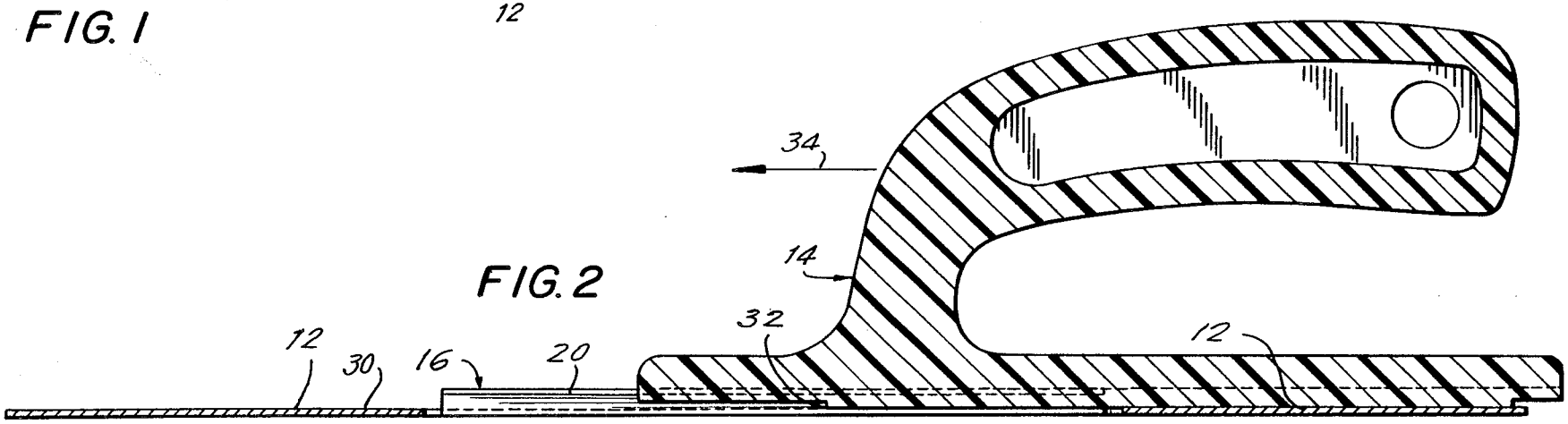
FIG. 2 is a sectional view taken along line 2—2 of FIG. 1 of the modular trowel assembly of FIG. 1.

Refering now to the drawings in detail, and initially to FIGS. 1 through 3 thereof, the presently prefered modular trowel assembly of the present invention, generally referred to by the reference numeral 10, is shown. As will be described in greater detail hereinafter, the modular trowel assembly 10 preferably includes two parts; i.e., namely a resilient substantially planar blade member trowel 12, such as one formed of spring steel or a low carbon hard rolled steel, such as one containing 0.25% carbon, and a handle member 14 slidably mountable thereon in a snap type fit. The handle member 14 is preferably a molded handle, such as one formed of polypropylene foam. As shown and prefered in FIG. 1, the modular trowel assembly 10 in its knock-down form in which it is shipped preferably contains an aperture 16 located along the longitudinal axis 18 thereof. The aperture 16 is preferably defined by a pair of spaced apart longitudinally extending resilient tangs 20 and 22 which are preferably integrally formed from the spring steel blade member 12 and, in the unassembled state, preferably extend upwardly in opposition to each other at an acute angle to the plane of the blade member 12, such as at a angle of 42° by way of example, as illustrated in FIG. 3. The handle member 14, as shown and preferred in FIG. 3, preferably includes a base portion 24 which contains a pair of slots 26 and 28, respectively, which are disposed therein in oppostion to each other and at an acute angle substantially complementary to the respective one of the tang 20 and 22 acute angles but differing therefrom by an amount sufficient to resiliently bias the respective tang 20 and 22 in the handle member slot 26 and 28, respectively, when the tang 20 and 22 is inserted therein for rigidly securing the mounted handle member 14 to the blade member 12 in the completed modular trowel assembly 10. Preferably, the handle member slots 26 and 28 are at an angle of 45° to the plane of the blade member 12 when the rest position of the tangs 20 and 22 in the unassembled state is at an acute angle of 42°. This 3° difference has been found to be sufficient to cause the tangs 20 and 22 to be resiliently biased when the handle member 14 is slidably mounted in a snap type fit to the blade member 12 so as to rigidly secure the handle 14 on the blade 12 in the assembled position of the modular trowel 10. This 3° change in position or orientation of the tangs 20 and 22 is illustrated in FIG. 3 with the unassembled position of the tangs 20 and 22 being shown in dotted lines in FIG. 3 and with the assembled position of the tangs 20 and 22 after the 3° angular change being shown in solid lines in FIG. 3.

As further shown and prefered in FIG. 1 and 2, a locking tab 30 is preferably disposed at the distal end of the aperture 16 so as to bear against a notch 32 (FIG. 2) located in the base portion 24 of the handle 14 for mating with the locking tab 30 to rigidly secure the mounted handle member 14 to the blade 12. In the example illustrated in FIGS. 1 and 2, the handle member 14 is slidably mounted on to the blade 12 by first aligning the slots 26 and 28 with the respective tangs 20 and 22 which protrude up from the aperture 16 and then the handle 14 is forceably snapped and slid on to the tangs 20 and 22 and moved in the direction of arrow 34 until the notch 32 engages the locking tab 30. The resultant completely assembled modular trowel 10 of the present invention is illustrated in FIGS. 4 and 5 which are sectional views of this assembly 10.

As shown by way of example in FIGS. 6 and 7, the blade 12 may be a notched blade such as one having the square notches 40 illustrated in FIGS. 6 or one having the triangular notches 42 illustrated in FIG. 7, depending on the end purpose of the modular trowel assembly 10 of the present invention. In addition, the locking tab 30 may be disposed at each end of the aperture 16 so that the handle 14 can be reversably mounted in either direction on the blade 12 depending on whether the blade 12 is to be used for right hand or left hand work, assuming the notches 40 or 42 are disposed on only one edge of the blade 12.

By utilizing the modular trowel assembly 10 of the present invention, the trowel may be shipped in knocked-down fashion occupying, by way of example, as much as 20% less package space, may be readily assembled by the user in a simple two piece assembly without the need for any tools, is a rigid assembly in which the handle 14 reinforces the rigidity of the blade 12, and, when a blade having notches on only one edge is to be employed, may readily be assembled for use for either right hand or left hand work merely by reversing the direction of the mounting of handle 14 to the blade 12.

What is claimed is:

1. A modular trowel assembly comprising a resilient substantially planar blade member and a handle member mounted thereon, said blade member having an aperture therein substantially disposed along the longitudinal axis of said blade member, said blade member aperture being defined by a pair of spaced apart longitudinally extending integral resilient tangs which are upwardly disposed in opposition to each other at an acute angle to the plane of said blade member to define a slot therebetween, said handle member having a base portion comprising a pair of longitudinally spaced apart slots therein capable of slidably receiving said resilient tangs therein, said handle member slots being in opposition to each other and disposed at an acute angle substantially complementary to the respective one of said tang acture angles but differing therefrom by an amount sufficient to resiliently bias said respective tang in said handle member slot when said tang is inserted therein for rigidly securing said mounted handle member to said blade member in said completed modular trowel assembly, said blade member aperture further comprising an integral resilient locking tab disposed at each end thereof for cooperating in permanently securing said mounted handle member to said blade member in said completed modular trowel assembly, said handle member base portion further comprising a notch disposed at each end thereeof for mating with one of said locking tabs for permanently securing said mounted handle member to said blade member in said completed modular trowel assembly, said mounted handle member in cooperation with said resilient tangs reinforcing the rigidity of said blade member.

2. A modular trowel assembly in accordance with claim 1 wherein said tang acute angle is substantially 42 degrees.

3. A modular trowel assembly in accodance with claim 2 wherein said handle slot acute angle is substantially 45 degrees.

4. A modular trowel assembly in accordance with claim 3 wherein said blade member is comprised of spring steel.

5. A modular trowel assembly in accordance with claim 4 wherein said handle member is comprised of a molded handle.

6. A modular trowel assembly in accordance with claim 5 wherein said molded handle member is comprised of polypropylene foam.

7. A modular trowel assembly in accordance with claim 1 wherein said handle slot acute angle is substantially 45 degrees.

8. A modular trowel assembly in accordance with claim 1 wherein said blade member is comprised of spring steel.

9. A modular trowel assembly in accordance with claim 8 wherein said handle member is comprised of a molded handle.

10. A modular trowel assembly in accordance with claim 9 wherein said molded handle member is comprised of polypropylene foam.

* * * * *